United States Patent [19]

Huang

[11] 4,422,190

[45] Dec. 27, 1983

[54] SAFETY TOILET SEAT

[76] Inventor: Chuan-Chih Huang, 10-4 Fl., No. 62, Chang Chun Rd., Taipei, Taiwan

[21] Appl. No.: 383,996

[22] Filed: Jun. 1, 1982

[51] Int. Cl.[3] ..... A47K 4/00; A47K 3/20

[52] U.S. Cl. ..... 4/420.3; 4/443; 4/444; 4/DIG. 6

[58] Field of Search ..... 4/420.1, 420.2, 420.4, 4/420.5, 447, DIG. 6, 443, 444, 448

[56] References Cited

U.S. PATENT DOCUMENTS

| | | | |
|---|---|---|---|
| 802,106 | 10/1905 | Matteson | 4/DIG. 6 |
| 929,079 | 7/1909 | Cresse | 4/DIG. 6 |
| 1,835,497 | 12/1931 | Kahn | 4/420.5 |
| 1,839,156 | 12/1931 | Lumpkin | 4/DIG. 6 |
| 2,600,619 | 6/1952 | Conterno | 4/420.4 |
| 2,875,450 | 3/1959 | Umann | 4/447 |
| 3,015,826 | 1/1962 | Aranas | 4/420.4 |
| 3,154,793 | 11/1964 | Congdon | 4/420.2 |

*Primary Examiner*—Henry K. Artis

[57] ABSTRACT

A safety toilet seat comprising a cassette jacket type seat, a water transporting system and a controlled heating system whereby the cassette jacket-type seat is made as a jacket, the interior of which is filled with water which is kept warm by the controlled heating system. A spray nozzle is provided at the front and rear of the cassette jacket-type seat and in communication with the interior thereof. The warm water in the seat is sprayed via the nozzles to thereby wash the anus and/or genitals of user seated thereon.

Conventionally heated toilet seats when used during the cold winter season are usually heated by means of an electric heating coil encased within the toilet seat. Additionally, if the toilet unit is equipped with a genital and/or anus wash washing unit, a second electric heating coil is necessary. Dual heating coils of this nature tent to waste energy, increase production cost and promote maintenance problems with respect to the toilet unit.

In conventional toilet seats having washing mean incorporated therein, the water stored between the nozzle and the heating coil is cold and when sprayed upon the appropriate body parts i.e. the vagina, anus or both, the coldness of the water provides a discomforting feeling to the user.

Moreover, in the interest of safety, the use of electric heating coils in a moisture existing bath or toilet room is discouraged since the potential for shock hazard is always present since the human body could very easily come in contact with current leaking from the heating coil should the heating coil malfunction.

6 Claims, 3 Drawing Figures

SAFETY TOILET SEAT

SUMMARY OF THE INVENTION

An object of the present invention is to overcome the afore-mentioned defects and hazards.

The main object of the present invention is to provide a toilet seat which is made as a jacket, filled with water therein and is kept warm by a heating control system provided therein so as to spray warm water for washing use and keep the toilet seat warm without additionally installing a heating coil therefor.

Another object of the present invention is to provide a toilet seat wherein the heating control system is formed with a circuit breaker for automatically switching off the power source once leaking electric current and formed with a transformer to reduce the input voltage to be a allowable safety value, such as 24 volts for user's safety.

DETAILED DESCRIPTION

Figure 1:
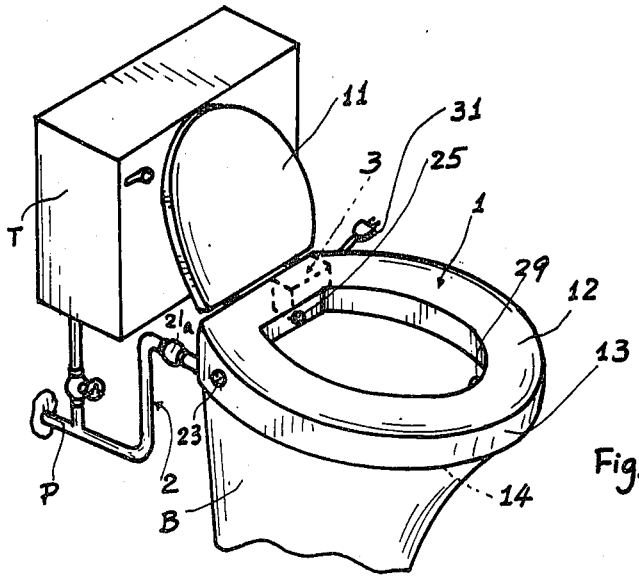
FIG. 1 is a perspective illustration of the present invention.
Figure 2:
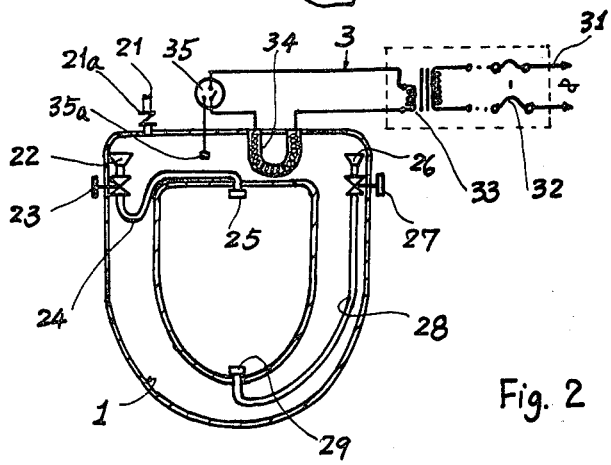
FIG. 2 is an illustration showing all parts of the present invention.
Figure 3:
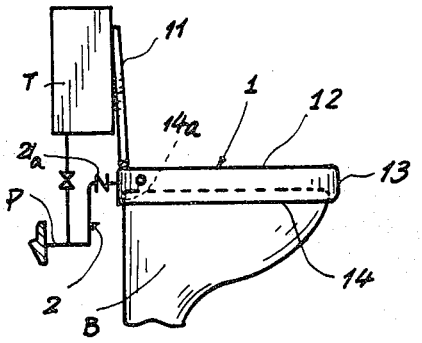
FIG. 3 is a side-view illustration of the present invention.

As shown in the drawings, the present invention comprises a cassette jacket-type seat 1, a water transporting system 2 and an electric heating control system 3.

The cassette jacket-type seat 1 comprises a toilet cover 11, a top plate 12, a side plate 13 and a bottom plate 14. Said top plate 12, said side plate 13 and said bottom plate 14 are fixed to form an integrated closed water jacket for containing water therein. Said jacket 1 is formed in a U shape or ring type configuration to correspond to the shape of the toilet bowl B. Said bottom plate 14 is formed with an extension 14*a* to engage with the top edge of the toilet bowl B.

The water transporting system 2 is connected to the water source P leading into the water closet tank T. An entrance pipe 21 including a check valve 21*a* is provided to carry water under pressure into said jacket 1. A water hopper 22 is formed within said jacket 1 and connected with a water conduit 24 wherein a valve 23 is provided therebetween. Said valve 23 has attached thereto a valve handle outside said jacket for operating use. Said water conduit 24 is terminated with a spray nozzle 25 which extends outside said jacket at the rear portion of said seat for spraying water for the human anus. Another hopper 26 is formed within said jacket to connect another water conduit 28 wherein a valve 27 is connected therebetween. Said valve 27 is extended outside said jacket for operating use. Said conduit 28 is terminated with a spray nozzle 29 which is positioned at the front side of said seat and extended outside said jacket for spraying water.

said electric heating control system 3 comprises a power source connector 31, a circuit breaker 32, a transformer 33 for reducing input voltage, a heating coil 34 and a thermostat 35 connected by a sensor 35*a* inserted into water in said jacket 1. Said transformer 33, for example, may reduce the input voltage, e.g., 110 volts to 24 volts to reduce the chance of electric injury for the Heating coil 34 heats the water in the interior of said jacket 1 and maintain a temperature of about 40° C. via said thermostat 35. As the water is uniformly heated within said jacket 1, the outgoing sprayed water is thus kept warm for comfortable washing of the genital area of the user and the top plate 12 or seat surface is also kept warm for comfortable sitting for the user.

Said heating control system 3 may be included in a cassette which is then built in said jacket as shown in dotted lines in FIG. 1. Of course, said circuit breaker 32 and said transformer 33 may be put into an adapter (not shown).

The conventional toilet seat may also be modified by fixing a bottom plate under the conventional seat to form a closed jacket as afore-mentioned.

I claim:

1. A safety toilet seat comprising:

a cassette jacket-type seat which is composed of a toilet seat cover, a top plate, a side plate and a bottom plate, said top plate, and said side plate and said bottom plate being fixed to form an integrated closed water jacket to correspond to the top edge of a toilet bowl;

a water transporting system connected to a source of water under pressure and the inlet of the associated water closet tank, conduit means intermediate said water transporting system and said jacket, whereby water is diverted from said water transporting system to said jacket, and an electric heating control system provided to heat the water within said jacket to provide heated water for washing the genital area of a user and a heated seat surface for sitting.

2. A toilet seat according to claim 1, wherein, said water transporting system comprises an entrance pipe connected with a check valve to lead water into said jacket, a water conduit having an inlet hopper, a valve having a handle attached thereto and extending outside said jacket, and being terminated with a spray nozzle extended outside said jacket at a rear position thereof and another water conduit having an inlet hopper, a second valve having a handle attached thereto and extending outside said jacket, and being terminated with a spray nozzle extending outside said jacket at a front position thereof.

3. A toilet seat according to claim 1, wherein, said electric heating control system comprises a power source connector, a circuit breaker to automatically trip the circuit in response to the presence of leaking current, a transformer for reducing input voltage to a lower safe voltage, a heating coil for heating water in said jacket and a thermostat to control said heating coil and thereby maintain a constant water temperature in said jacket.

4. A toilet seat according to claim 1, wherein, said electric heating control system is made as a cassette type located in said jacket put into an adapter near the power source connector.

5. A toilet seat according to claim 1, wherein said bottom plate of said jacket is made as an extension of a conventional toilet seat and engages the toilet bowl located thereunder.

6. A toilet seat according to claim 4, wherein, said circuit breaker and said transformer are in the form of an adapter and located outside said jacket in close proximity to the power source connector.

* * * * *